US006129060A

United States Patent [19]

Koda

[11] Patent Number: 6,129,060

[45] **Date of Patent: *Oct. 10, 2000**

[54] CAMSHAFT PHASE CHANGING APPARATUS

[75] Inventor: Masanori Koda, Kanagawa, Japan

[73] Assignee: Unisia Jecs Corporation, Atsugi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/042,470

[22] Filed: Mar. 16, 1998

[30] Foreign Application Priority Data

Mar. 19, 1997 [JP] Japan ..... 9-065693

[51] Int. Cl.[7] ..... F01L 13/00

[52] U.S. Cl. ..... 123/90.17; 123/90.31

[58] Field of Search ..... 123/90.12, 90.15, 123/90.17, 90.31; 74/568 R; 464/1, 2, 160, 161

[56] References Cited

U.S. PATENT DOCUMENTS

| | | | |
|---|---|---|---|
| 5,203,290 | 4/1993 | Tsuruta et al. | 123/90.17 |
| 5,301,639 | 4/1994 | Satou | 123/90.17 |
| 5,309,873 | 5/1994 | Suga et al. | 123/90.17 |
| 5,669,343 | 9/1997 | Adachi | 123/90.17 |
| 5,722,356 | 3/1998 | Hara | 123/90.17 |
| 5,765,518 | 6/1998 | Nakano | 123/90.17 |
| 5,799,631 | 9/1998 | Nakamura | 123/90.17 |

FOREIGN PATENT DOCUMENTS

| | | |
|---|---|---|
| 42 27 619 | 2/1993 | Germany . |
| 7-139316 | 5/1995 | Japan . |
| 8-121124 | 5/1996 | Japan . |

*Primary Examiner*—Weilun Lo
*Attorney, Agent, or Firm*—Foley & Lardner

[57] ABSTRACT

A camshaft phase changing apparatus for an internal combustion engine has a control valve interposed in a hydraulic circuit. The control valve controls the connection between one of first and second hydraulic passages and the hydraulic supply passage and the connection between the other of the first and second hydraulic passages to the hydraulic drain passage according to the engine driving condition. The first and second hydraulic passages are linked to a corresponding one of an advance-angle side hydraulic chamber and a retardation-angle side hydraulic chamber defined between a rotatable main body and a sleeve fitted on the camshaft. The control valve has a first port connecting the hydraulic drain passage to either the first or second hydraulic passage, and a second port connecting the hydraulic supply passage to the other of the first or second hydraulic passage. The first port has a cross-sectional area that is narrower than that formed on the second port when a cam phaser thereof is moved to adjust a rotational phase relationship between a rotary body and the camshaft.

11 Claims, 7 Drawing Sheets

CAMSHAFT PHASE CHANGING APPARATUS

The contents of a Patent Application No. Heisei 9-65693 filed in Japan on Mar. 19, 1997 is herein incorporated by reference.

BACKGROUND OF THE INVENTION a) Field of the Invention

The present invention relates to a camshaft phase changing apparatus for varying a timing of a valve actuation for an engine driven camshaft.

b) Description of the Related Art

A Japanese Patent Application First Publication No. Heisei 7-139316 published on May 30, 1995 exemplifies a previously proposed camshaft phase changing apparatus in an internal combustion engine.

The previously proposed camshaft phase changing apparatus disclosed in the above-identified Japanese Patent Application First Publication includes: a cylindrical timing pulley to which a torque is transmitted from a timing belt via a crankshaft of the engine; a camshaft having a cam on an outer peripheral surface thereof and a sleeve fixed on one end of the camshaft and inserted into a cylindrical main body of the timing pulley; and a cylindrical gear which is enabled to move in a forward-and-rearward direction thereof and is meshed via outer and inner beveled teeth thereof with the cylindrical main body of the timing pulley and the sleeve.

The previously proposed camshaft phase changing apparatus further includes: advance-angle side and retardation-angle side hydraulic chambers formed within an internal of the cylindrical main body of the timing pulley, into which pressurized working oil is supplied via a hydraulic circuit, and from which the pressurized working oil is exhausted via the hydraulic circuit. Hence, the cylindrical gear is moved in the forward-and-rearward direction thereof according to a difference in the hydraulic pressures in the advance-angle side hydraulic chamber and the retardation-angle side hydraulic chamber so that a relative rotational phase between the timing pulley and the camshaft is converted. Thus, a valve-opening-and-closing timing thereof, for example, a suction valve is controlled toward an advance angle side or toward a retardation angle side.

In addition, a hydraulic control valve is interposed in hydraulic passages communicating the respective advance-angle side and retardation-angle side hydraulic chambers with a working oil pump.

A spool valve body having a large-diameter portion and small-diameter portion is slidably held within a cylindrical valve seat. In addition, a plurality of openings communicating with the hydraulic passage are formed at predetermined positions on a peripheral wall of the valve seat along an axial direction of the spool valve body. In order to render a leaked working oil to fall within an allowable range, a seal length of the adjacent openings having a high hydraulic pressure difference is set to be elongated and the seal length between the adjacent openings having a low hydraulic pressure difference is set to be short. Consequently, an axial length of the whole valve seat can be shortened.

SUMMARY OF THE INVENTION

However, in the previously proposed camshaft phase changing apparatus, in a case where a retardation angle control for the suction valve is carried out according to the engine driving condition, the spool valve body of the hydraulic control valve is slid in one direction (in the axial direction of the spool valve body) so that a hydraulic passage linked to the working oil pump is communicated with one of the hydraulic passages linked to a corresponding one of the retardation-angle side hydraulic chamber and the advance-angle side passage hydraulic chamber to supply the pressurized working oil into the retardation-angle side hydraulic chamber and so that a drain hydraulic passage is communicated with the other of the hydraulic passages linked to the other of the retardation-angle side hydraulic chamber and the advance-angle side hydraulic chamber to exhaust the pressurized working oil chamber from the advance-angle side hydraulic chamber. On the other hand, in a case where an advance angle control for the suction valve is carried out according to the engine driving condition, the spool valve body of the hydraulic control valve is slid in the other direction (in the axial direction of the spool valve body) so that the hydraulic passage linked to the working oil pump is communicated with one of the hydraulic passages linked to the corresponding one of the retardation-angle side and the advance-angle side hydraulic chambers to supply the pressurized working oil into the advance-angle side hydraulic chamber and so that the drain hydraulic chamber is communicated with the other of the hydraulic passages linked to the other of the retardation-angle and advance-angle side hydraulic chambers to exhaust the pressurized working oil from the retardation-angle side hydraulic chamber.

That is to say, during the advance angle control or the retardation angle control, at the same time when the pressurized working oil is supplied to either one of the advance-angle or retardation-angle side hydraulic chambers, all of the pressurized working oil within the other of the advance-angle or retardation-angle side hydraulic chambers is speedily exhausted externally from the drain passage.

Hence, when the cylindrical gear is moved toward either one of the advance-angle side hydraulic chamber or the retardation-angle side hydraulic chamber, the one of the retardation-angle side or the advance-angle side hydraulic chamber instantaneously indicates a low pressure state.

When the cylindrical gear is moved toward, for example, a forward retardation-angle side hydraulic chamber or a rearward advance-angle side hydraulic chamber from an intermediate position at which the hydraulic pressures of both of the advance-angle side chamber and the retardation-angle side chamber are approximately equal or toward a rearward-angle side hydraulic chamber from the intermediate position.

In these cases, the cylindrical gear repeats the stops and movements. In such repetitive movements, a stick slip can easily occur on the cylindrical gear.

In details, when the cylindrical gear is moved from the intermediate position to either of the forward retardation-angle side hydraulic chamber or the rearward retardation-angle side hydraulic chamber and stops at a predetermined position, an inertia force of a mass of the cylindrical gear in the movement direction is acted on the cylindrical gear. Consequently, the cylindrical gear is slightly moved due to its inertia force in either the hydraulic chamber which indicates the lower hydraulic pressure chamber. Then, the cylindrical gear cannot stop at a desired position. A responsive characteristic for the cylindrical gear to stop at the desired position from the intermediate position is worsened.

It is therefore an object of the present invention to provide an improved camshaft phase changing apparatus for an internal combustion engine which improves the responsive characteristic of the cylindrical gear to move at the desired position so that an accurate control of a valve opening-and-closing timing can be achieved.

The above-described object can be achieved by providing an apparatus for an internal combustion engine, comprising:

a rotary body driven by the engine to be rotated in synchronization with a revolution of the engine;

a camshaft rotatable about a camshaft axis together with the rotary body;

a cam phaser intervened between the rotary body and the camshaft for adjusting a rotational phase relationship between the rotary body and the camshaft;

a pair of first and second hydraulic chambers, formed in an inner space between the rotary body and the camshaft and partitioned by the cam phaser, for moving the cam phaser between the pair of the first and second hydraulic chambers to adjust the rotational phase relationship between the rotary body and the camshaft according to a difference in hydraulic pressures in the pair of the first and second hydraulic chambers;

a hydraulic circuit having a hydraulic source, a hydraulic supply passage led from the hydraulic source; a pair of first and second hydraulic passages, each of the first and second hydraulic passages being linked to a corresponding one of the pair of the first and second hydraulic chambers, and a hydraulic drain passage for draining a pressurized working oil from either one of the first or second hydraulic chamber to the hydraulic source, the hydraulic circuit supplying the pressurized working oil to either one of the pair of the first or second hydraulic chamber from the hydraulic source and draining the pressurized working oil from the other of the pair of the first or second hydraulic chamber to the hydraulic source;

a determinator for determining an engine driving condition; and a control valve, interposed in the hydraulic circuit, for controlling switchings of a connection of either one of the first or second hydraulic passage to the hydraulic supply passage and of a connection of the other of the first or second hydraulic passage to the hydraulic drain passage according to the engine driving condition, a cross sectional area of an orifice formed on a first port of the control valve for connecting the hydraulic drain passage to either one of the first or second hydraulic passage being set to be narrower than that formed on a second port of the control valve for connecting the hydraulic supply passage to the other of the first or second hydraulic passage when the cam phaser is moved between the pair of the first and second hydraulic chambers to adjust the rotational phase relationship between the rotary body and the camshaft.

BEST MODE FOR CARRYING OUT THE INVENTION

Reference will hereinafter be made to the drawings in order to facilitate a better understanding of the present invention.

Figure 1:
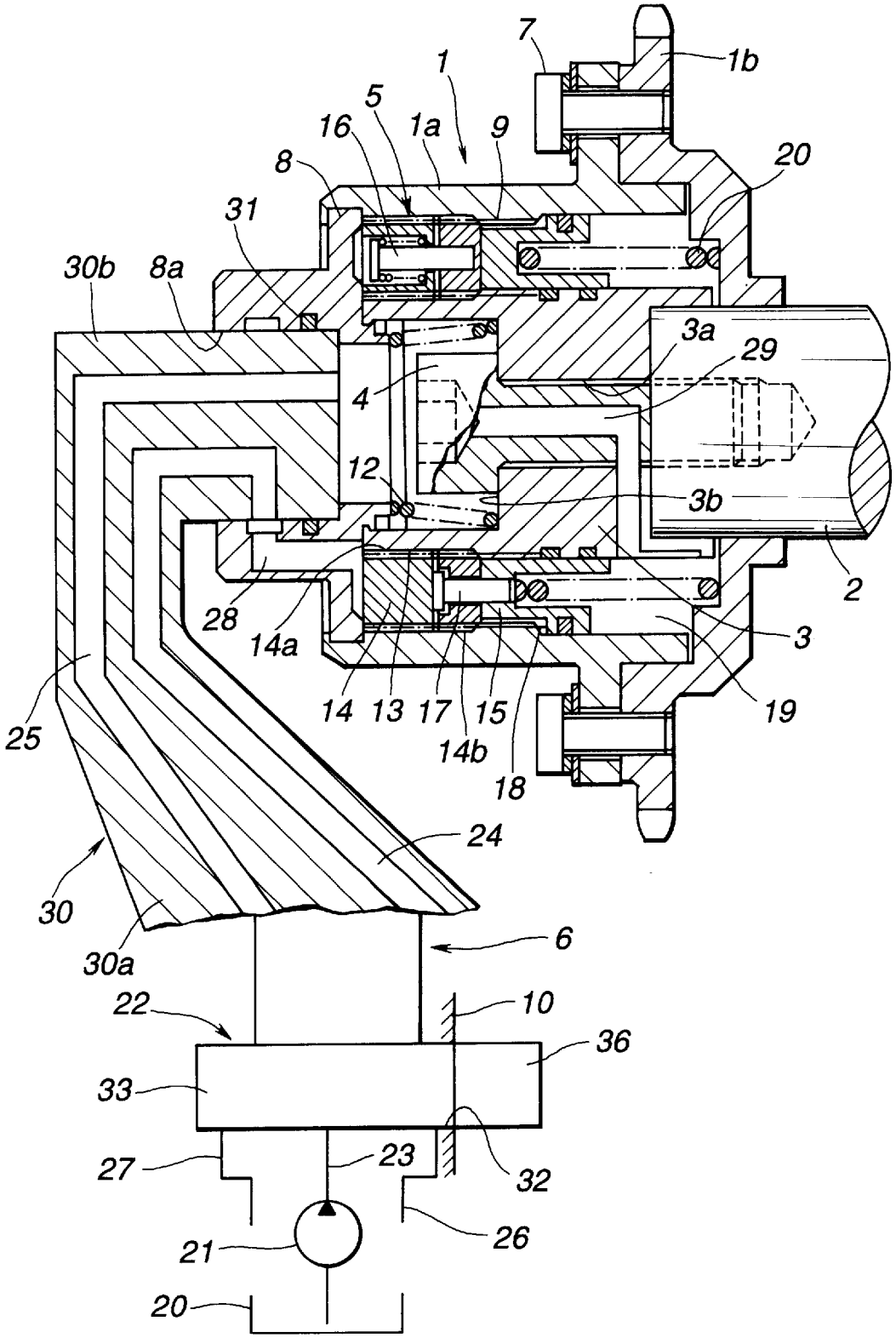
FIG. 1 is a cross sectional view of a camshaft phase changing apparatus according to the present invention.
Figure 2:
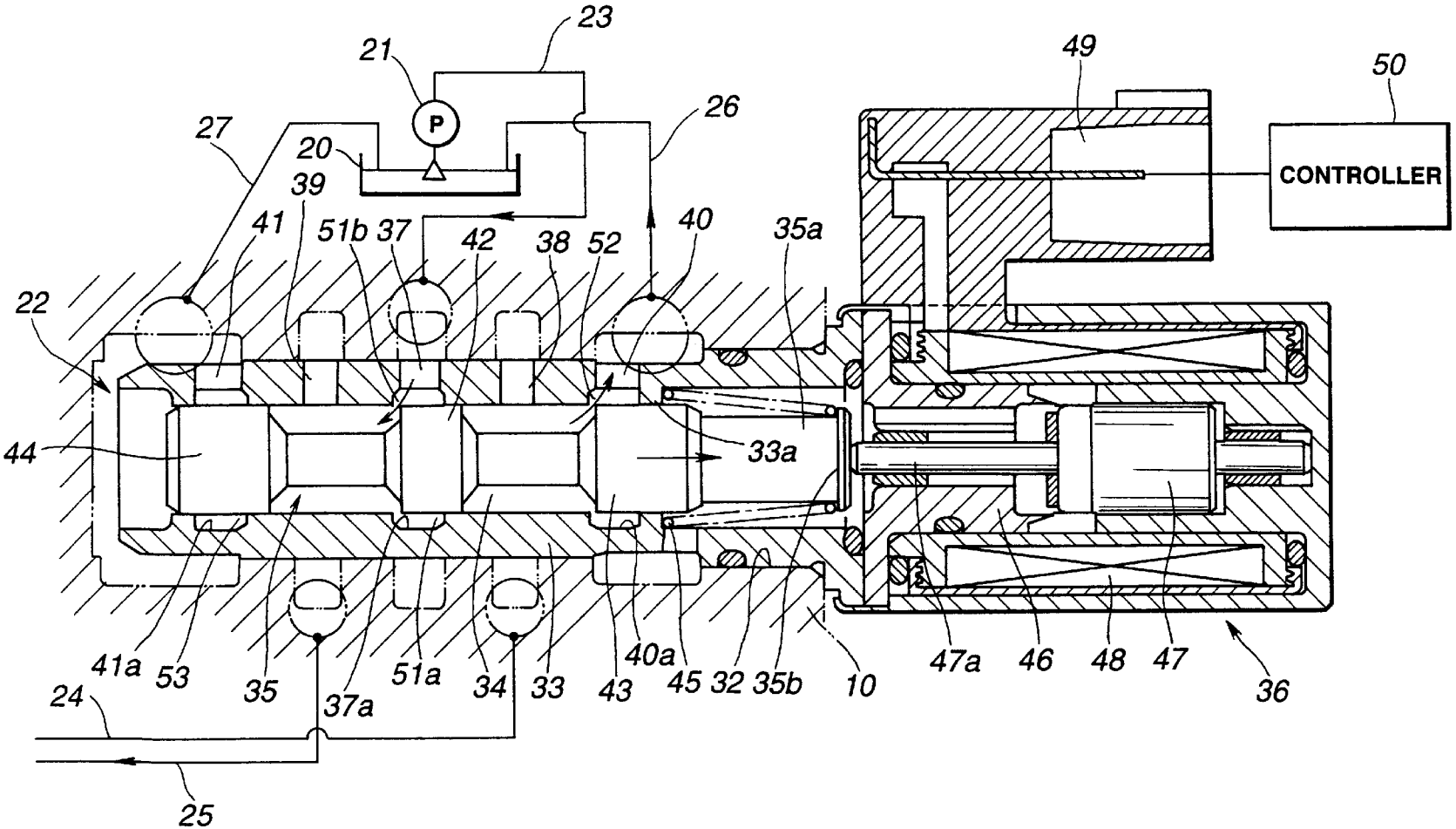
FIGS. 2, 3, and 4 are longitudinal cross sectional views of an electromagnetically controlled valve installed in the camshaft phase changing apparatus shown in FIG. 1.
Figure 3:
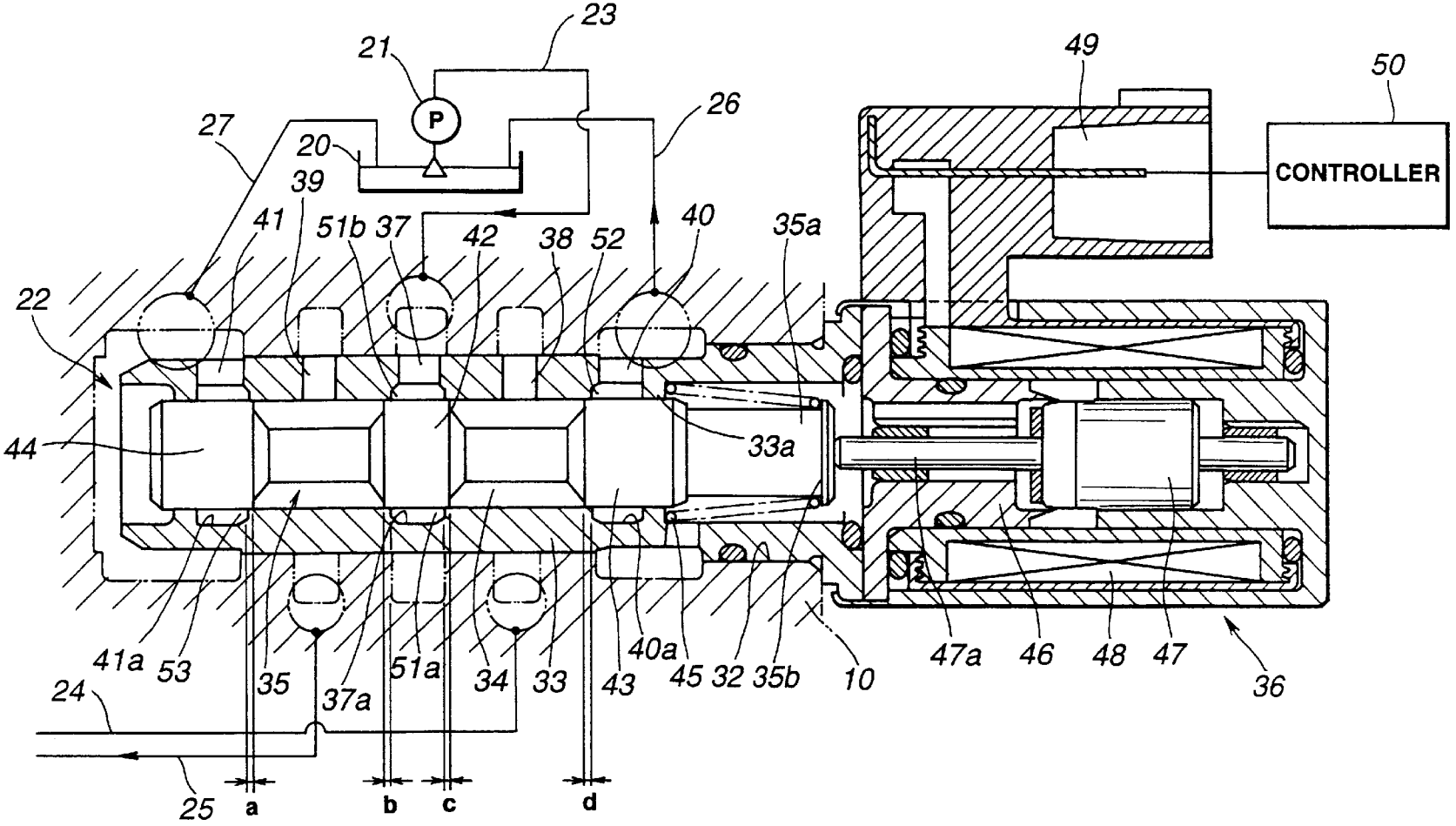

FIGS. 1, 2, and 3 show a first preferred embodiment of a variable camshaft phase changing apparatus according to the present invention.

As typically shown in FIG. 1, a sprocket of a rotary body 1 is provided to which a rotational force (torque) is transmitted from an engine crankshaft via a timing chain. A camshaft 2 on end of which a sleeve 3 is fixed by means of a bolt 4 through an axial direction thereof and having a cam on a peripheral surface thereof is provided and a cam phaser 5 is intervened between a cylindrical main body 1*a* of the sprocket 1 and the sleeve 3 on the camshaft 2. A hydraulic circuit 6 is provided for moving the cam phaser 5 in an axial direction of the camshaft 2 according to an engine driving condition as will be described later.

A gear portion 1*b* of the sprocket 1 on which the timing chain is wound is fixed by means of the bolt 7 at one end of a cylindrical main body la which faces the camshaft 2. In addition, a front cover 8 is caulked on a front end portion of the sprocket 1. Beveled type teeth 9 are formed on an inner peripheral surface of a front end portion of the sprocket 1.

In addition, an inner periphery at the bent center of the gear portion 1*b* is slidably supported on the outer peripheral surface of the camshaft 2. Furthermore, the front cover 8 is approximately of a cylindrical shape and is formed with a retaining hole 8*a* at a center thereof.

The camshaft 2 has one end which faces the sleeve journalled by means of a camshaft bearing installed on an upper end of a cylinder head on a cylinder block 10. The sleeve 3 is approximately of a cylindrical shape and has a hole 3*a* formed so as to be penetrated in an axial direction of an inner part of a partitioning wall located at a center of the sleeve 3.

A cylindrical fixed end of the sleeve 3 is fitted into one end of the camshaft 2. On the other hand, a fitting groove 3*b* is formed within a cylindrical tip end of the sleeve 3 into which a head of the bolt 4 is fitted. Beveled type outer teeth 13 are formed on an outer periphery of the cylindrical tip end of the sleeve 3. In addition, a coil spring 12 is interposed between a bottom surface of the fitting groove 3*b* and a cylindrical inner periphery of the front cover 8 and is biased in a direction such that the sprocket 1 is separated from the camshaft 2 to suppress a generation of a striking sound against the camshaft 2 due to a thrust force acted toward the sprocket 1.

In the first embodiment, the cam phaser 5 includes: a cylindrical gear 14 interposed between the sleeve 3 and the cylindrical main body la of the sprocket 1; and a piston 15. The cylindrical gear 14 includes two (first and second) gear elements split in a direction perpendicular to the axis of the camshaft 2. Beveled inner teeth 14*a* and outer teeth 14*b* are formed on inner and outer peripheral surfaces of the cylindrical gear 14 which are meshed with first end inner teeth 9 of the main body 1*a* of the sprocket 1 and an outer teeth 13 of the sleeve 3. In addition, both of the first and second gear elements of the cylindrical gear 14 are linked elastically in a direction so as mutually approach to each other by means of a pin 16 and the sprocket 1 in order to absorb clearances due to backlashes generated between each of the teeth 9, 13, 14*a*, and 14*b*. The piston 15 is approximately of a cylindrical shape and is linked to the second gear element via a supporting pin 17 inserted under a pressure into the cylindrical gear 14 at a predetermined position in the peripheral direction thereof.

A hydraulic circuit 6 serves to supply or exhaust (drain) working oil (hydraulic pressure) to or from an advanced-angle side working oil (hydraulic) chamber 18 formed at a front side (a left-handed side in FIG. 1) of the cam phaser 5 and to supply or exhaust the hydraulic pressure to or from a retardation-angle side working oil (hydraulic) chamber 19 formed at a rear side (a right-handed side in FIG. 1) of the cam phaser 5, respectively.

An oil pump 21 serves as a hydraulic source. The working oil within an oil pan 20 is pressurized and supplied by the oil pump 21 toward an electromagnetically controlled valve 22 via a pressurized hydraulic supply passage 23.

The hydraulic circuit 6 further includes: a pair of first and second working oil (hydraulic) passages 24 and 25 branched from the electromagnetically controlled valve 22 and connected to the corresponding one of the advanced-angle side and the retardation-angle side hydraulic chambers 18 and 19; and a pair of first and second hydraulic drain passages 26 and 27 connected to both ends of the electromagnetically controlled valve 22 for returning the working oil exhausted from the corresponding one of the advance-angle side and the retardation-angle side hydraulic chambers 18 and 19 to the inside of the oil pan 20.

The pair of the first and second hydraulic passages 24 and 25 are approximately juxtaposed into a working oil passage element 30. One end of the first (working oil) hydraulic passage 24 is communicated into the advance-angle side (working oil) hydraulic chamber 18 via a communication hole 28 in a crank shape formed within the front cover 8 and one end of the second working oil passage 25 is communicated into the retardation-angle side (working oil) hydraulic chamber 19 via a communication hole 29 formed within the bolt 4 and the sleeve 3. It is noted that the working oil element 30 is formed independently of the sprocket 1 and the camshaft 2. A lower end 30*a* of the working oil element 30 is fixed on a side part of the cylinder block 10 by means of a bolt. On the other hand, a cylindrical upper end 30*b* of the working oil passage element 30 is inserted into a supporting hole 8*a* of the front cover 8 via a seal ring 31 having a wear resistance characteristic so that the front cover 8, in other words, the front end of the sprocket 1 is rotatably supported on the upper end 30*b* of the working oil passage element 30.

Figure 4:
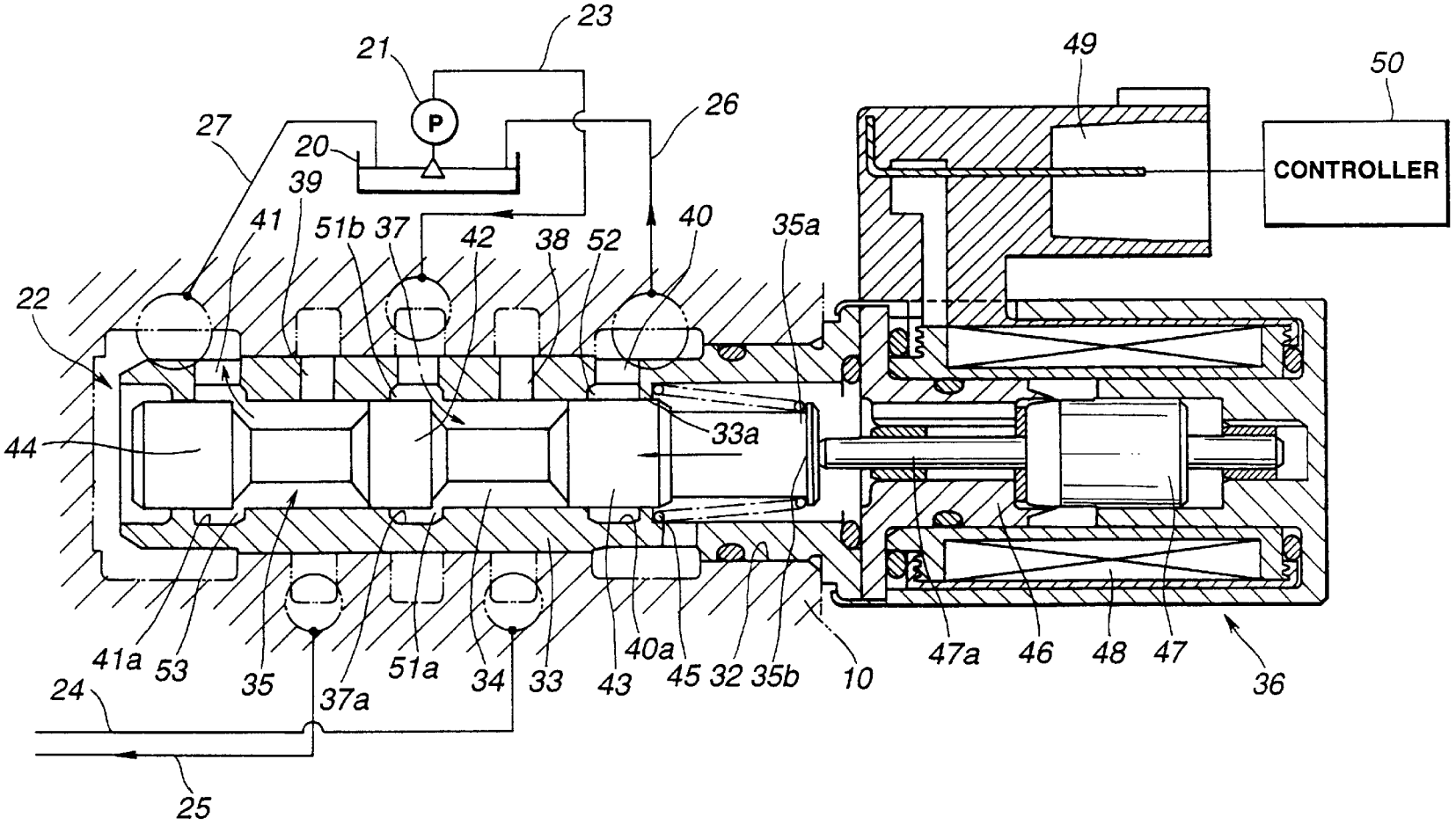

The electromagnetically controlled valve 22 includes: a cylindrical valve seat 33 inserted into a retaining hole 32 of the cylinder block 10 as shown in FIGS. 2 through 4; a spool valve body 35 installed slidably in a valve hole 34 formed within the valve seat 33 for switchable connections of the hydraulic passages as will be described later; and an electromagnetic actuator 36 of a proportional solenoid type for actuating the spool valve body 33 to be slid along the axial direction of the spool valve body 33 against a biasing force of a valve spring 45 as will be described later.

The valve seat 33, as typically shown in FIG. 2, includes; a supply port (second port) 37 formed on an approximately center portion of a peripheral wall of the valve seat 33 so as to communicate between a downstream end of the supply passage 23 connected to the oil pump 21 and the valve hole 34; fifth and sixth ports 38 and 39 formed on both lateral sides with respect to the supply port 37 so as to communicate other ends of the first and second hydraulic passages 24 and 25 with the valve hole 34. Annular grooves 37*a*, 40*a*, and 41*a* having larger diameters than that of the inner peripheral surface of the valve seat 33 are formed on the inner surface of third and fourth ports 40 and 41. The third and fourth ports 40 and 41 are formed on further lateral sides of the fifth port 38 and of the sixth port 39 respectively, each for the connection thereof to the correspondig one of the first and second hydraulic drain passages 26 and 27.

The spool valve body 35 is provided with a first valve body 42 having a larger diameter than another part of the spool valve body 35 for opening or closing the supply port 37 at the center of a small-diameter axis portion of the spool valve body 35 and provided with large-diameter second and third valve bodies 43 and 44 for opening or closing the third and fourth ports 40 and 41 at both ends of the small-axis portion of the spool valve body 35.

In addition, the spool valve body 35 is provided with the valve spring 45 of a conical shape resiliently intervened between an umbrella portion 35*b* of the spool valve body 35 and a spring seat 33*a*. The umbrella portion 35*b* is located at one end edge of a supporting axle 35*a* at the front end of the spool valve body 35. The spring seat 33*a* is located on an inner peripheral wall of the valve hole 34 at its front end. The valve spring 45 is biased in the arrow-marked rightward direction of FIG. 2 so that the first valve portion 42 serves to communicate the supply port 37 with the second working oil passage 25 via the sixth port 39. The electromagnetic actuator 36 includes a core 46, a movable plunger 47, a coil 48, and a connector 49. A drive rod 47*a* is fixed on a tip of the movable plunger 47 for pressing the umbrella portion 35*b* of the spool valve body 35. The electromagnetic actuator 36 is actuated or controlled upon a receipt of a control signal having a predetermined pulsewidth from a controller 50, which determines an engine driving condition from a revolution speed sensor and an engine load sensor (not shown) and outputting the control signal to the electromagnetic actuator 36 whose pulsewidth is dependent on the engine driving condition.

As shown in FIG. 2 or FIG. 4, together with a sliding movement of the spool valve body 35 toward a maximum forward direction (maximum rightward direction of FIG. 2) or a rearward direction (maximum leftward direction of FIG. 4) of the spool valve body 35, during the phase retardation angle control operation (FIG. 2) or the phase advance angle control operation (FIG. 4), a cross sectional area of one of orifices of hydraulic supply control orifices 51*a* and 51*b* formed between both end edges of the first valve part 42 and both inner edges of the groove 37*a* of the supply port 37 is set so as to be slighty wider than the cross sectional area of one of hydraulic exhaust control orifices 52 and 53 formed between respective end edges of the second and third valve parts 43 and 44 and respective end edges of the grooves 40*a* and 41*a* of the third and fourth ports 40 and 41. In other words, the hydraulic exhaust control orifices 52 and 53 are rather throttled. The throttling quantity is set so as not to affect the movement of the cylindrical gear 14 by means of the pressurized working oil supplied within each hydraulic chamber 18 and 19.

As shown in FIG. 3, during an intermediate position control in which the spool valve body 35 is placed at an intermediate position between the maximum leftward and rightward positions, a seal width a by which the third valve part 44 seals the end edge of the groove 41*a* of the fourth port 41 is set to be wider than a seal width b by which the first valve part 42 seals one end edge (51*b*) of the groove 37*a*. In addition, the seal width c by which the first valve part 42 seals the other end edge (51*a*) of the groove 37*a* of the supply port 37 is set so as to be narrower than the seal width d by which the second valve part 43 seals the other end edge (52) of the groove 40*a* of the third port 41. Furthermore, each of the seal widths of b and c is narrower than each of the seal widths of a and d. Thus, at the intermediate position of the spool valve body 35 described above, the spool valve body 35, the valve seat 33, and the valve hole 34 are formed so that the pressurized working oil from the supply port 37 is leaked slightly into respective hydraulic chambers 18 and 19 via respective hydraulic passages 24 and 25.

In the first embodiment, during a low-speed-and-light-engine-load region of the engine driving condition, an OFF signal (,i.e., the control signal of a minimum pulsewidth (zero)) is output to the electromagnetic actuator 36 from the controller 50. The spool valve body 35 is slid along the valve seat 33 in the rightward direction (at a minimum position shown in FIG. 2) by means of a spring force (biasing force) exerted by the valve spring 45 (with the drive rod 47*a* drawn into the electromagnetic actuator 36). Hence, at the same time when the first valve part 42 opens the one supply control orifice 51*b* of the groove 37*a* of the supply port 37, the second valve part 43 opens the one hydraulic exhaust control orifice 52 of the groove 40*a* of the third port 40. Then, the fourth valve part 44 closes the other exhaust control orifice 53 of the groove 41*a* of the fourth port 41. The working oil pressurized and supplied from the oil pump 21 is speedily supplied to the retardation-angle side hydraulic chamber 19 via the supply port 37, the one hydraulic supply control orifice 51*b*, the valve hole 34, the sixth port 39, and the second hydraulic passage 25. In addition, the working oil within the advance-angle side hydraulic chamber 18 is rather slowly exhausted (drained) within the oil pan 20 via the first hydraulic passage 24, the fifth port 38, the valve hole 34, the other hydraulic exhaust control orifice 52, the third port 40, and the first hydraulic drain passage 26.

Hence, an inner pressure of the retardation-angle side hydraulic chamber 19 becomes high but that of the advance-angle side working oil chamber 18 becomes low. Consequently, the cylindrical gear 14 is moved at the maximum forward end (leftmost end) via the piston 15 as shown in FIG. 1. Thus, the sprocket 1 is relatively pivoted at one side so that the phase is converted, thereby a valve opening timing of a suction valve(s) being lagged through the cam of the camshaft 3 and a valve overlap to an exhaust valve(s) being reduced. A combination efficiency can be improved and stable drive and improvement in a fuel economy can be achieved.

The cylindrical gear 14 moves toward the maximum forward direction along with a higher pressurization in the retardation-angle side hydraulic chamber 19. However, since the throttling effect of the hydraulic exhaust control orifice 52 causes the exhaust velocity of the working oil toward the hydraulic source (oil pan 20) to be lowered, an abrupt drop in pressure of the advance-angle side working oil (hydraulic) chamber 18 can be suppressed.

A movement responsive characteristic of the cylindrical gear 14 is, thus, improved and an excessive movement of the cylindrical gear 14 (as the movable body) toward the forward direction, i.e., toward the advance-angle side working oil (hydraulic) chamber 18 can be suppressed.

Specifically, since a movement control over the piston 15 is carried out with the responsive hydraulic chambers 18 and 19 maintained under the relatively high pressures, a value of an apparent volume elastic modulus of the working oil within the respective hydraulic chambers 18 and 19 become large. Consequently, a movement time lag of the piston 15 (or the cylindrical gear 14) becomes small and the responsive characteristic is improved. That is to say, $P=K(Q-A\cdot Y)/V$, wherein P denotes the inner pressure of each working oil chamber 18 and 19 per unit time, K denotes the apparent volume elastic modulus of the working oil, Q denotes a flow quantity of the working oil into and from each hydraulic chamber 18 and 19, A denotes a cross sectional area of the piston 15, Y denotes a piston velocity, and V denotes a volume of each hydraulic chamber 18 and 19.

Therefore, the inner pressure in each working oil chamber 18 and 19 is proportional to the apparent volume elastic modulus of the working oil. The movement responsive characteristic of the piston 15 can be improved by maintaining the pressure in both of the hydraulic chambers 18 and 19 at high levels.

On the other hand, if the engine driving condition is transferred from the low-engine-revolution-speed-and-heavy-engine-load region to a high-revolution-speed-and-heavy-engine-load region, the control signal of a maximum pulsewidth is output to the electromagnetic actuator 36. At this time, the spool valve body 35 is slid in the forward (arrow-marked leftward) direction as shown in FIG. 4 against the spring (biasing) force exerted by the valve spring 45 with the drive rod 47*a* extended at a maximum from the electromagnetic actuator 36. At the same time when the third valve part 43 closes the hydraulic exhaust control orifice 52 of the groove 41*a* of the fourth port 41, the fourth valve part 44 opens the exhaust control passage 53. The first valve part 42 closes the one hydraulic supply control orifice 51*b* of the groove 37*a* of the supply port 37 and opens the other hydraulic supply control orifice 51*a* of the groove 37*a* of the supply port 37. Hence, the working oil is supplied into the advance-angle side hydraulic chamber 18 via the other supply control orifice 51*a*, the fifth port 38, and the first hydraulic passage 24.

In addition, the working oil within the retardation-angle side hydraulic chamber 19 is exhausted into the oil pan 20 via the second hydraulic passage 25, the sixth port 39, the one hydraulic exhaust control orifice 53, the fourth part 41, and the second drain passage 27. The inner pressure of the retardation-angle side hydraulic chamber 19 becomes low. Hence, the cylindrical gear 14 moves conversely toward the maximum rear end (,i.e., toward the lowered hydraulic chamber 19). Thus, the relative phase conversion of both camshaft 2 and the sprocket 1 is carried out so that the opening timing and the closing timing of the intake valve(s) are advanced. Consequently, the valve overlap with the exhaust valve(s) can be enlarged, the output of the engine due to an improvement in a suction charge efficiency can be enlarged.

It is noted that the abrupt reduction of pressure of the retardation-angle side hydraulic chamber 19 is suppressed due to the throttling effect of the exhaust control orifice 53 so that the improvement in the movement responsive characteristic and the excessive movement of the cylindrical gear 14 can be prevented. Then, the stable movement of the cylindrical gear 14 can be achieved.

Next, when the engine driving condition is transferred into a middle-engine-revolution-speed-and-a-middle-engine-load region, the spool valve body 35 in response to the control signal from the controller 50 closes all of the supply port 37 and the third and fourth ports 40 and 41 with the spool valve body 35 held at the intermediate position as shown in FIG. 3. Hence, the cylindrical gear 14 is held at an intermediate position and the opening and closing timings of the suction valve (s) is controlled at predetermined opening and closing timings. Hence, the engine performance according to the engine driving condition can sufficiently be improved.

The seal widths b and c of both end edges between the first valve part 42 and the groove 37*a* of the supply port 37 are set to be narrower than those of a and d described above. Hence, the working oil supplied under the pressure to the supply port 37 is slightly leaked into the valve port 34 from the parts of the seal widths b and c. Furthermore, a slight quantity of the working oil from the supply port 37 is supplied to each hydraulic chamber 18 and 19 via the respective first and second ports 38 and 39 and the first and second hydraulich passages 24 and 25. Hence, it is possible to stably hold the cylindrical gear 14 at an intermediate movement position between the maximum forward and maximum rearward positions via the piston 15.

In addition, since it is not necessary to largely set the first valve part 42 of the spool valve body 35 in the axial direction of the spool valve body 35, the length of the spool valve body 35 in the axial direction can be shortened. Consequently, the whole electromagnetically controlled valve 22 can be compacted.

Figure 5:
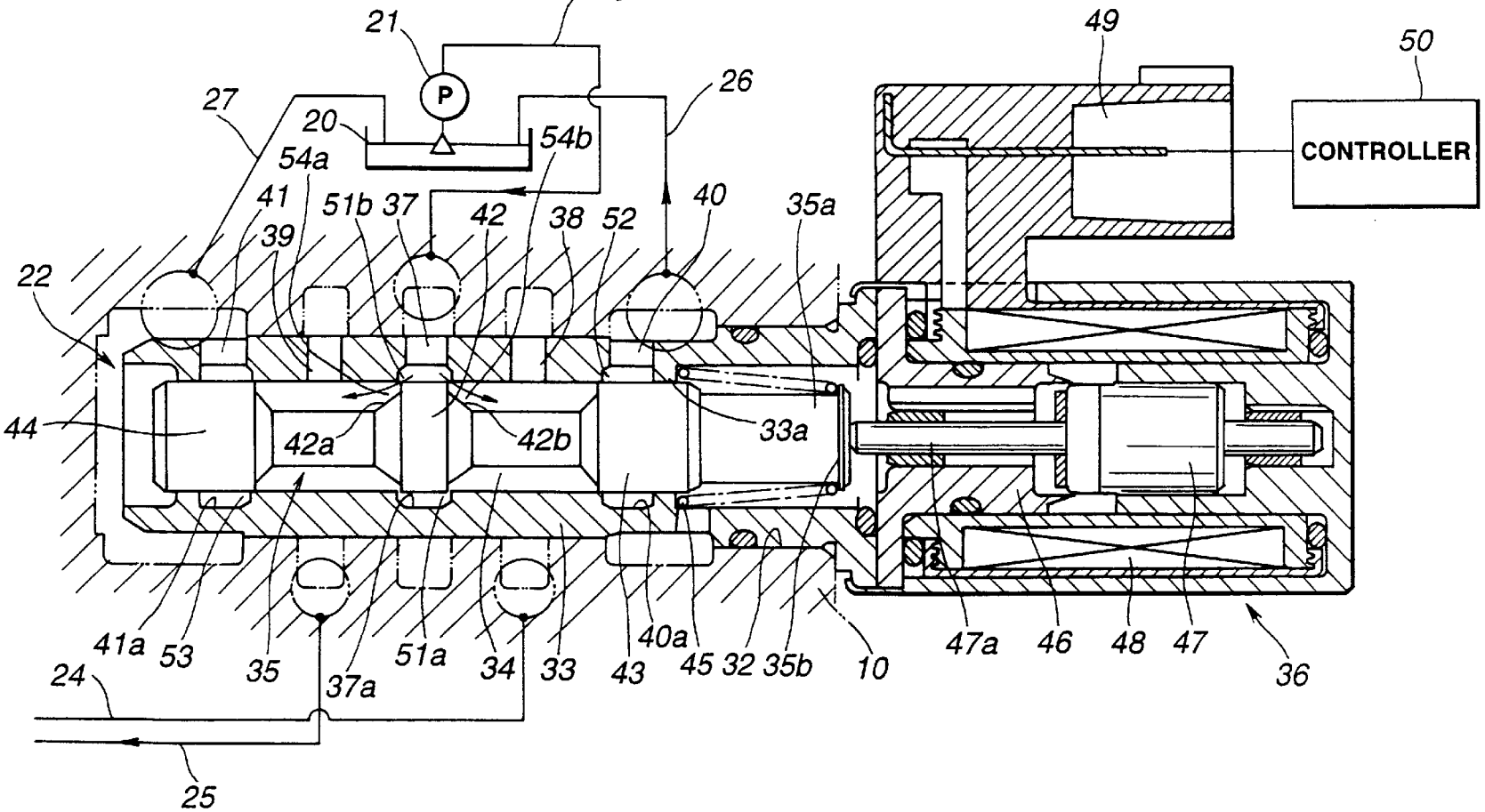
FIG. 5 is an essentially cross sectional view of the electromagnetically controlled valve installed in the camshaft phase changing apparatus in a second preferred embodiment according to the present invention.

FIG. 5 shows a second preferred embodiment of the camshaft phase changing apparatus according to the present invention.

The basic structure is the same as that in the first embodiment shown in FIGS. 1 through 4. However, both side edges of the first valve part 42 are formed in tapered conical surfaces 42*a* and 42*b*. Hydraulic supply passages 54*a* and 54*b* which communicate the supply port 37 with the valve hole 34 are positively formed between both edges (51*a* and 51*b*) of the groove 37*a* of the supply port 37 and the tapered conical surfaces 42*a* and 42*b* at the intermediate position of the spool valve body 35. Hence, at the intermediate position of the spool valve body 35, the pressurized working oil supplied to the supply port 37 is caused to flow through each hydraulic supply passage 54*a* and 54*b* into the respective hydraulic passages 24 and 25. Hence, the cylindrical gear 14 is stably maintained at the intermediate position due to an even relative working oil pressure of the respective hydraulic chambers 18 and 19. Consequently, the stable valve timing control at the intermediate region can be achieved. The other advantages as those in the case of the first embodiment can be achieved.

Figure 6:
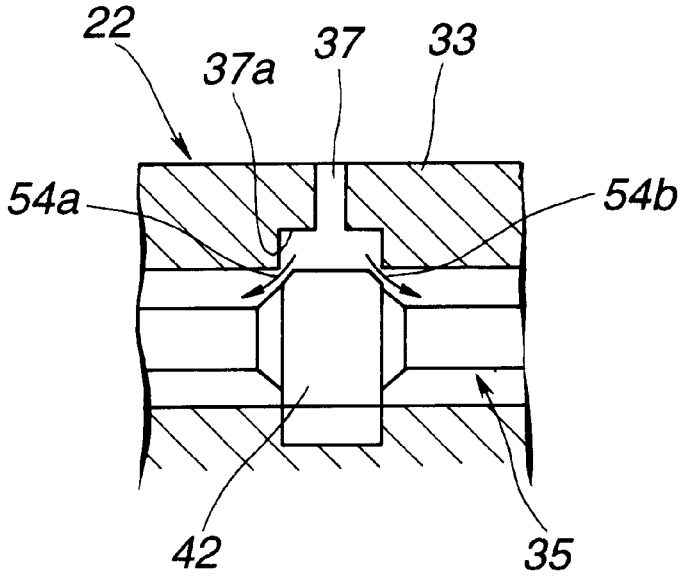
FIG. 6 is an essentially cross sectional view of the electromagnetically controlled valve installed in the camshaft phase changing apparatus in a third preferred embodiment according to the present invention.

FIG. 6 shows a third preferred embodiment of the camshaft phase changing apparatus according to the present invention.

A part of both end edges at the supply port 37 facing against the edges of the first valve part 42 of the spool valve body 35 is cut out so as to form the supply passages 54*a* and 54*b* as in the case of the second embodiment. Hence, since, at the intermediate position of the spool valve body 35, the working oil is supplied to each working oil chamber 18 and 19 via the supply passages 54*a* and 54*b*. The same advantages as described in the second embodiment shown in FIG. 5 can be achieved.

Figure 7:
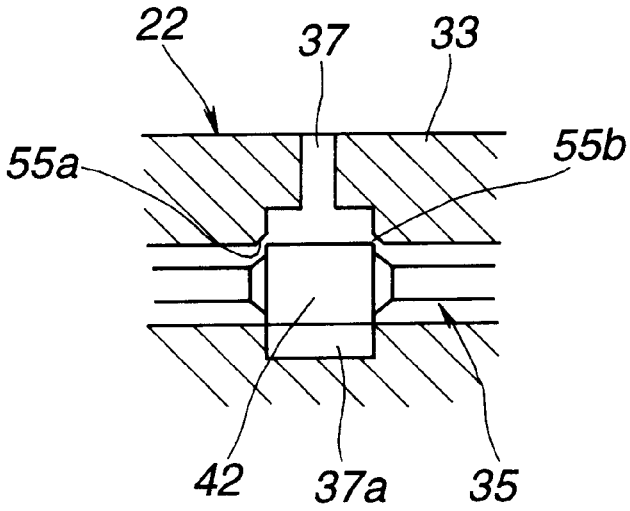
FIG. 7 is an essentially cross sectional view of the electromagnetically controlled valve installed in the camshaft phase changing apparatus in a fourth preferred embodiment according to the present invention.

FIG. 7 shows a fourth preferred embodiment of the camshaft phase changing apparatus according to the present invention.

Both end edges of the groove 37*a* are, in turn, cut out to form supply passages 55*a* and 55*b*, in the fourth embodiment.

Figure 8:
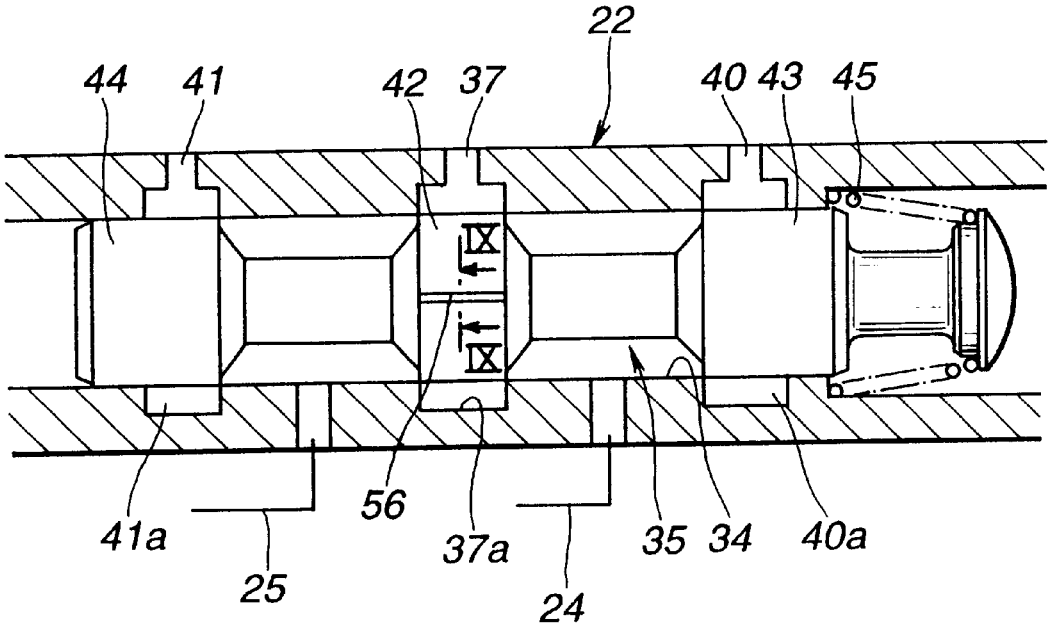
FIG. 8 is an essentially cross sectional view of the electromagnetically controlled valve installed in the camshaft phase changing apparatus in a fifth preferred embodiment according to the present invention.
Figure 9:
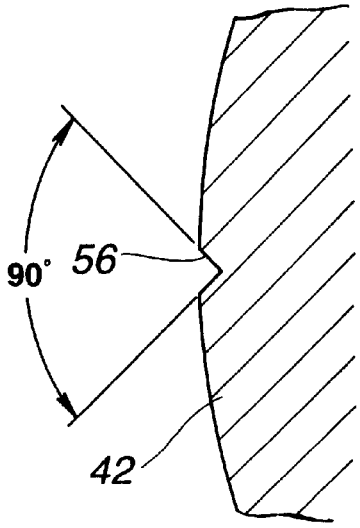
FIG. 9 is a cross sectional view of the electromagnetically controlled valve shown in FIG. 8 cut away along a line IX—IX.

FIGS. 8 and 9 show a fifth embodiment of the camshaft phase changing apparatus according to the present invention. The other structure of the camshaft phase changing apparatus is the same as that described in the first embodiment.

A letter V-shaped elongated cutout having an arc angle of approximately 90° is formed in an axial direction of an outer peripheral surface of the first valve part 42. Consequently, a single supply passage 56 is formed which is communicated with the fifth port 38 and the sixth port 39. It is of course that the same advantages as those described in the second embodiment can be achieved.

It is noted that if the spool valve body 35 is moved in either a leftward or a rightward direction in the first embodiment, the working oil is supplied to the valve hole in the closed state via the supply passage 56. At this time, since either the third port 40 or the fourth port 41 is opened, the working oil cannot be caused to flow into the working oil passage in the closed state.

Although the cam phaser 5 in each embodiment includes the cylindrical gear 14 and the piston 15 as described above, the present invention is applicable to a vane type cam phase changing apparatus having the cam phaser only constituted by a single element.

The cam phaser of the vane type cam phase changing apparatus is exemplified by a Japanese Patent Application First Publication No. Heisei 8-121124 published on May 14, 1996.

In details, in the disclosed cam phase changing apparatus, the timing pulley, a shoe-shaped housing, and a front plate are coaxially fixed by means of two bolts. In addition, the timing pullley, the shoe-shaped housing, and a rear plate are coaxially fixed by means of four bolts. An inner peripheral wall of a bossof the rear plate is fitted to a tip of the camshaft so as to be enabled to be relatively pivotable to the camshaft. An outer peripheral wall of the boss of the rear plate is contacted against an oil seal of the cylinder head. The shoe-shaped housing is a housing of a vane rotor so as to enable the vane rotor to be pivoted about its axis and includes a pair of mutually opposed trapezoidally-shaped first and second shoes. Each of mutually opposed surfaces of the pair of the first and second shoes is formed of an arc shape in cross section. Circumferential clearances of the first and second shoes are formed with arc shaped spaces as housing chambers. Each of flange portions of the shoe housing is inserted between the timing pulley and the rear plate and is fixed by means of a bolt. In addition, both radial ends of the vane rotor are formed as arc-shaped first and second vanes. The arc-shaped first and second vanes are pivotably housed in the arc-shaped spaces of the first and second shoes of the shoe-shaped housing. An inner wall portion of the vane rotor is coaxially fitted onto the camshaft by means of two bolts. A cylindrical projection of the vane rotor is mutually pivotably fitted to the inner peripheral wall of the boss of the front plate, Mimute clearances are provided between an outer peripheral wall of the vane rotor and an inner peripheral wall of the shoe-shaped housing so that the vane rotor can be pivoted relative to the shoe-shaped housing. The minute clearances are sealed by means of a pair of seal members. It is noted that one of two retardation-angle side hydraulic chambers is formed between the first shoe and the first vane, the other retardation-angle side hydrauli chamber is formed between the second shoe and the second vane, one of two advance-angle side hydraulic chambers is formed between the first shoe and the second vane, and the other advance-angle side hydraulic chamber is formed between the second shoe and the first vane. In the structure described above, the timing pulley, the shoe-shaped housing, the front plate, and the rear plate can integrally be rotated. The camshaft and the vane rotor can coaxially be pivoted relative to the timing pulley, the shoe-shaped housing, the front plate, and the rear plate. In the disclosed vane type cam phase changing apparatus, the pair of the first and second hydraulic chambers correspond to the two mutually symmetrically opposed advance-angle side hydraulic chambers and the two mutually symmetrically opposed retardation-angle side hydraulic chambers, the cam phaser correspond to the vane rotor having the first and second vanes, and the pair of the first and second hydraulic passages from the control valve (electromagnetically controlled valve) are connected to the two mutually symmetrically opposed advance-angle side hydraulic chambers and the two mutually symmetrically opposed retardation-angle side hydraulic chambers, respectively. (The above-identified Japanese Patent Application First Publication No. Heisei 8-121124 is herein incorporated by reference). Thus, the cam phaser is not limited to a movable body having the cylindrical gear and the piston and moved along the axis of the camshaft as shown in FIG. 1 but may be constituted by the vane rotor pivotably housed in the shoe-shaped housing.

It is noted that the controller 50 determines which one of three regions the engine driving condition falls within according to sensor signals of the engine revolution speed and the engine load, the three regions being the low-engine-revolution-speed-and-light-engine-load region, the middle-engine-revolution-speed-and-middle-engine-load region, and the high-engine-revolution-speed-and-heavy-engine-load region. The controller 50 is exemplified by a U.S. Pat. No. 5,309,873, the disclosure of which is herein incorporated by reference.

It is noted that the electromagnetically controlled valve corresponds to the control valve and the controller corresponds to the determinator.

What is claimed is:

1. A camshaft phase changing apparatus for an internal combustion engine, comprising:

a rotary body adapted to be rotated by the engine in synchronism therewith;

a camshaft rotatable about its axis together with the rotary body;

a chamber formed between the camshaft and the rotary body;

a cam phaser positioned in the chambers wherein the cam phaser adjusts a rotational phase relationship between the rotary body and the camshaft and partitions the chamber into a first hydraulic chamber and a second hydraulic chamber, wherein the cam phaser is movable between the first and second hydraulic chambers based on applied pressure differences therebetween to adjust the rotational phase relationship between the rotary body and the camshaft;

a hydraulic circuit having:

a hydraulic source;

a hydraulic supply passage led from the hydraulic source;

a pair of first and second hydraulic passages, the first hydraulic passage communicating with The first hydraulic chamber and the second hydraulic passage communicating with the second hydraulic chamber; and a hydraulic drain passage that drains pressurized working oil from one of the first and second hydraulic chambers to the hydraulic source, wherein the hydraulic circuit supplies the pressurized working oil to one of the first and second hydraulic chambers from the hydraulic source and drains the pressurized working oil from the other ot the first and second hydraulic chambers to the hydraulic source depending on an engine driving condition;

a determinator that determines the engine driving condition; and a control valve interposed in the hydraulic circuit, the control valve controlling fluid supply to or drainage from the first hydraulic chamber through the first hydraulic passage and fluid drainage from or supply to the second hydraulic passage through the second hydraulic supply passage according to the engine driving condition, wherein the control valve has a first port and a second port, the first port connecting the hydraulic drain passage to one of the first and second hydraulic passages, and the second port connecting the hydraulic supply passage to the other of the first and second hydraulic passages, wherein the hydraulic drain passage includes a pair of first and second hydraulic drain passages linked to the hydraulic source and wherein the control valve includes:

a valve seat;

an electromagnetic actuator;

a spool valve body having a valve hole formed in a peripheral wall of the valve seat, the spool valve body being slidably disposed in the valve hole, wherein the first port of the control valve includes a third port and a fourth port, both of the third port and the fourth port being formed on the peripheral wall of the valve seat, the third port connecting the first hydraulic drain passage to the first hydraulic passage and the fourth port connecting the second hydraulic drain passage to the second hydraulic passage;

a fifth port connecting the first hydraulic passage to one of the hydraulic supply passage and the first hydraulic drain passage; and a sixth port connecting the second hydraulic passage to one of the hydraulic supply passage and the second hydraulic drain passage, the spool valve body having first, second, and third valve parts for integrally varying the orifice cross sectional areas of the second, third, and fourth ports when the cam phaser is moved between the pair of the first and second hydraulic chambers to adjust the rotational phase relationship between the rotary body and the camshaft, wherein the second port is formed as an annular groove on the peripheral wall of the valve seat, and an axial length of the first valve part is slightly shorter than a width of the annular groove of the second port taken along the direction of the axial length of the first valve part.

2. A camshaft phase changing apparatus for an internal combustion engine as claimed in claim 1, wherein the camshaft is provided with a cam attached on a peripheral surface of the camshaft, the cam being adapted to variably control an opening timing of a suction valve of the engine, wherein the determinator determines whether the engine driving condition falls in a low-engine-revolution-speed-and-light-engine-load region, and wherein the first, second, and third valve parts of the spool valve body vary the orifice cross sectional areas of the second, third, and fourth ports such that the orifice cross sectional area of the third port is narrower than that of the second port with the orifice cross sectional area of the fourth port zeroed when the determinator determines that the engine driving condition falls in the low-engine-revolution-speed-and-light-engine-load region so that the hydraulic pressure of the second hydraulic chamber becomes higher than that of the first hydraulic chamber and the cam phaser moves in a direction of the camshaft axis toward the first hydraulic chamber to adjust the rotational phase relationship between the rotary body and the camshaft such that the valve opening timing of the suction valve is retarded.

3. A camshaft phase changing apparatus for an internal combustion engine as claimed in claim 2, wherein the control valve further includes a spring that biases the spool valve body to slide to a first position at which the orifice cross sectional area of the third port is narrower than that of the second port with the orifice cross sectional area of the fourth port zeroed, and a drive rod extending from the electromagnetic actuator, which actuates the drive rod to slide the spool valve body against a biasing force of the spring according to a pulsewidth of a control signal from the determinator, the pulsewidth of the control signal being dependent upon the engine driving condition.

4. A camshaft phase changing apparatus for an internal combustion engine as claimed in claim 3, wherein the determinator determines whether the engine driving condition falls in a high-engine-revolution-speed-and-heavy-engine-load region and outputs the control signal of a maximum pulsewidth to the electromagnetic actuator when determining that the engine driving condition falls in the high-revolution-speed-and-heavy-engine-load condition so that the spool valve body is slid against the biasing force of the spring by the drive rod of the electromagnetic actuator to a second position such that the orifice cross sectional area of the fourth port is narrower than that of the second port with the orifice cross sectional area of the third port zeroed so that the hydraulic pressure of the first hydraulic chamber becomes higher than that of the second hydraulic chamber and the cam phaser slides in the direction of the camshaft axis toward the second hydraulic chamber so that the valve opening timing of the suction valve is advanced.

5. A camshaft phase changing apparatus for an internal combustion engine as claimed in claim 4, wherein when the determinator determines that the engine driving condition falls in the low-engine-revolution-speed-and-light-engine-load region, the determinator outputs the control signal of a minimum pulsewidth so that the spool valve body is slid by the spring force of the spring at the first position and the drive rod is drawn into the electromagnetic actuator.

6. A camshaft phase changing apparatus for an internal combustion engine as claimed in claim 5, wherein the determinator determines whether the engine driving condition falls in a middle-engine-revolution-speed-and-middle-engine-load region and outputs the control signal of an intermediate pulsewidth between the maximum and minimum pulsewidths to the electromagnetic actuator when determining that the engine driving condition falls in the middle-engine-revolution-speed-and-middle-engine-load region so that the spool valve body is slid against the biasing force of the spring by the drive rod of the electromagnetic actuator to a third position between the first and second positions at which the orifice cross sectional areas of the third, and fourth ports are zeroed and the first valve part supplies the working oil from the second port to both of the fifth and sixth ports via the valve hole.

7. A camshaft phase changing apparatus for an internal combustion engine as claimed in claim 6, wherein both edges of a peripheral surface of the first valve part facing the second port are provided with cutouts.

8. A camshaft phase changing apparatus for an internal combustion engine as claimed in claim 6, wherein both ends of an opening of the second port facing the first valve part are provided with cutouts.

9. A camshaft phase changing apparatus for an internal combustion engine as claimed in claim 6, wherein the third and fourth ports are annular grooves formed on the peripheral wall of the valve seat.

10. A camshaft phase changing apparatus for an internal combustion engine as claimed in claim 6, wherein the first valve part is provided with tapered conically-shaped surfaces on both side surfaces of the first valve part to form hydraulic supply passages against the second port when the spool valve body is slid at the third position.

11. A camshaft phase changing apparatus for an internal combustion engine as claimed in claim 6, wherein a seal width by which the first valve part seals one end edge of the second port is narrower than that by which the second valve part seals one end edge of the third port and is narrower than that by which the third valve part seals one end edge of the fourth port when the spool valve body is placed at the third position.

* * * * *